United States Patent [19]

Dolowy, Jr. et al.

[11] 4,259,112

[45] Mar. 31, 1981

[54] PROCESS FOR MANUFACTURE OF REINFORCED COMPOSITES

[75] Inventors: Joseph F. Dolowy, Jr.; Bradley A. Webb; Edward C. Supan, all of Los Angeles, Calif.

[73] Assignee: DWA Composite Specialties, Inc., Chatsworth, Calif.

[21] Appl. No.: 27,250

[22] Filed: Apr. 5, 1979

[51] Int. Cl.[3] ..... B22F 3/22; B22F 7/02

[52] U.S. Cl. ..... 75/208 R; 75/211; 75/226; 75/229; 428/549

[58] Field of Search ..... 75/DIG. 1, 208 R, 211, 75/229, 226; 428/549

[56] References Cited

U.S. PATENT DOCUMENTS

| | | | |
|---|---|---|---|
| 2,375,211 | 5/1945 | Brennan | 428/549 |
| 3,432,295 | 3/1969 | Frank et al. | 75/DIG. 1 |
| 3,759,708 | 9/1973 | Sundberg et al. | 75/DIG. 1 |
| 3,887,365 | 6/1975 | Sherfey | 75/DIG. 1 |
| 3,888,661 | 6/1975 | Levitt et al. | 428/549 |
| 3,889,348 | 6/1975 | Lemelson | 428/549 |

*Primary Examiner*—Brooks H. Hunt
*Attorney, Agent, or Firm*—Lawrence D. Weber

[57] ABSTRACT

Composite materials are prepared by mixing metal powder and dissimilar reinforcement materials in a fluid binder to form a slurry. The slurry is spread to form thin sheets which are air dried. The sheets are stacked to a predetermined thickness and placed in a vacuum retort where binder is removed at elevated temperature and reduced pressure. The resulting composite material is consolidated and bonded at elevated temperature and pressure.

7 Claims, No Drawings

PROCESS FOR MANUFACTURE OF REINFORCED COMPOSITES

BACKGROUND OF THE INVENTION

This invention relates to a method of manufacturing composite materials comprising a metal matrix reinforced with fibers or other dissimilar material.

The method disclosed differs from the prior art in that uniform distribution and random orientation of fibers, or whiskers, throughout the matrix is effected with little or none of the fiber/matrix segregation, or clumping or "bird's nesting" of the fibers which has been noted in the short fiber or whisker reinforced composites made by other methods.

The process further affords safety in handling of fine, metal powders in that the binder coats the particles and prevents air oxidation.

PRIOR ART

The prior art recognizes that fibers and single crystal whiskers of many materials have exceptionally high tensile strengths and elastic moduli approaching theoretical values. The incorporation of such materials into a metal matrix has provided materials with physical properties superior to those of alloys of the same metals, or of different metals of equivalent weight.

In recent years, particularly with the sophisticated demands of the aerospace technology, the development of composite materials for certain uses in place of metal alloys has made considerable progress.

The primary thrust of the prior art appears to be in achieving a composite material wherein the fibers, or whiskers, are directionally oriented. The directional orientation was required by the belief that randomly oriented composites had poorer tensile strengths than those where the fibers were aligned in a single direction. The tensile strength of the directionally oriented fiber composite was found to be significantly greater in the direction of fiber orientation.

However, transverse properties of composites with directional orientation of the fiber reinforcing materials are quite poor. Under transverse loads, these materials tend to separate or delaminate along the lines of fiber orientation.

The poorer tensile strength previously achieved in composites with randomly oriented fibers was due, in part at least, to clumping of matrix powder, "bird's nesting" of randomly oriented reinforcing fiber, and segregation of matrix metal powder from reinforcing fibers, such that the final composite material was manifestly non-uniform as to component distribution.

Accordingly, it is an object of this invention to provide a novel and non-obvious method for making a high strength, composite material comprising a metal powder matrix with reinforcing fibers of a different material wherein the fibers are uniformly distributed and randomly oriented in the matrix to provide a well bonded composite material with uniform physical properties in all directions.

Another object of the invention is to provide a process wherein the handling of a finely divided metal powder is accomplished in a safe manner.

Further objects of the invention will become apparent from the summary of the invention and the detailed description which follow.

SUMMARY OF THE INVENTION

The present invention is a process for producing composite materials comprising a metal matrix with reinforcing fibers of a different material wherein the reinforcing fibers are uniformly distributed in random orientation throughout the matrix.

Metal powder and reinforcing fibers are mixed with a fluid binder to form a slurry wherein the viscosity of the binder is sufficient to retain the powder and fibers in a dispersed but suspended state within the fluid. The resulting mixture is poured onto a form and screeded in order to form thin sheets or films of predetermined thickness. The sheets are air dried to remove binder solvent. The dried sheets are then cut to a predetermined size and stacked to a predetermined thickness, placed in a vacuum retort and subjected to reduced internal pressure within the retort and elevated temperature to remove residual solvent and binder. After a suitable time, the stack of sheets at reduced internal pressure is subjected to high external pressure and high temperature to effect consolidation and bonding of the matrix/fiber composite.

DESCRIPTION OF THE INVENTION

Powder of a metal, such as aluminum, magnesium, copper, titanium, aluminum alloys or ferrous alloys, is mixed in a fluid binder to form a slurry. The particle size of the metal powder can be selected from the range from superfine submicron size, (less than 325 mesh) to commercially available sizes in the range of less than $\phi$mesh, or even coarser sizes. Reinforcing material is added at the same time in the form of irregular particles, rods, whiskers, fibers or commercially available tow such as silicon carbide whiskers, chopped boron fibers, chopped alumina tow, chopped graphite tow, or chopped metal wire (typically stainless steel, tungsten or ferrous alloys). The reinforcing material may also be made up into a separate slurry which is then mixed with the matrix slurry.

The binder is a solution in a standard solvent, such as toluene, of an organic, polymeric material such as, but not limited to, polystyrene, polyisobutanol or acrylic resin. The binder selected for forming the slurry is prepared by dissolving polymer in sufficient solvent to produce a fluid of viscosity sufficient to keep the metal powder particles and the fibers in a dispersed and suspended state once they are mixed into the fluid binder. The viscosity chosen is dependent upon the density difference between the metal powder and the reinforcing material, the particle and fiber sizes, and particle and fiber shapes.

The slurry is formed by mixing powder and reinforcing material with a predetermined and measured amount of binder. Sufficient binder must be used to coat the metal powder particles in order to protect them from air oxidation and to afford safety from dust explosion or respiratory problems for operating personnel.

Various conventional methods have been found practicable for mixing the metal powder and reinforcing fibers into the fluid binder to form the slurry. Included are paddles, rollers, blenders, paint mixers, and even the simple technique of introducing the fluid binder through a hole in the top of the powder container and then mixing in situ by use of a paint mixer. Some powders which are particularly subject to air oxidation, or which represent a potential respiratory hazard to operating personnel, may require the use of an inert atmosphere in a device such as a glove box for the mixing step.

The slurry is prepared by mixing together all of the ingredients to achieve a uniform fluid mixture with suspended and dispersed metal and reinforcing fibers.

The resulting slurry is poured and screeded onto a form to provide a film or sheet in the thickness range from 0.005–0.100 inches. The form is backed up with a Mylar sheet to provide a smooth bottom surface and to act as a release agent. The slurry is screeded to form the final film or sheet thickness and to break up any "bird's nests" of fibers and to remove any gas or air bubbles. Screeding can be done by use of a roller, set at the proper thickness dimension of the film, or by use of a squeegee or other wiping device set for the proper thickness dimension.

The resulting film, or sheet, is allowed to air dry to a non-tacky surface condition.

Several sheets prepared by this procedure are cut to desired dimensions and stacked to a thickness determined by the final thickness required of the finished product.

The stack of sheets is placed in a suitable tool or die of desired shape, and set in a vacuum retort. A vacuum is pulled on the retort to reduce pressure to approximately 200 microns, and the temperature is raised to about 800 degrees Fahrenheit (800° F.). At these temperature and pressure conditions, the binder solvent vaporizes and is removed by the vacuum, and the polymeric binder itself gasifies or sublimes and is also removed by the vacuum. The resulting product has a clean metal powder-to-reinforcement surface.

The temperature is then raised to a value either below the initial melting point of the metal powder for solid state diffusion bonding, or is raised to a level between the solidus and liquidus phases, or to a level entirely within the molten range of the metal powder. The pressure in the retort is then raised to a value between 100 psi and 3000 psi, depending upon the metal powder used to form the matrix of the final composite material.

The high temperature and pressure are maintained for approximately 1 to 20 minutes, and then the resulting composite is cooled.

Cooling under pressure down to the solidus temperature range of the matrix alloy can comprise an important part of the consolidation of the final product. As in the following example related to aluminum alloy matrix and silicon carbide (SiC) whiskers, it is desireable to "wet" the reinforcing fibers to promote bonding to the matrix alloy at the liquidus temperature, or higher, under pressure of at least 100 psi. Cooling under pressure causes the closing of shrinkage voids which would otherwise be caused by liquid-to-solid phase changes, minor constituent surface contamination, or entrapped gases.

Containment of the totally molten matrix alloy under pressure is difficult. Therefore, it is desireable to keep the pressure low but sufficient to promote "wetting" and subsequent bonding of the fibers and matrix alloy as well as to achieve complete densification of the composite.

The containment problem is eased considerably as the temperature is lowered, and a gradual increase in pressure of about 250 psi for each 10 degree drop in temperature was found to be both practicable and satisfactory, up to at least about 2000 psi pressure. The pressure is maintained until the solidus temperature of the matrix alloy is reached and freezing is complete.

Cooling under pressure imparts a certain amount of hot working to the material which causes the composite to act more like wrought aluminum than cast aluminum. Sheet material made from SiC whiskers and 2024 aluminum alloy powder and cooled under pressure exhibited remarkable ductility which was not observed in material not cooled under pressure.

An additional advantage which can be achieved by this invention is the ability to "clad" the final composite. This is accomplished after the air dried sheets are stacked to a predetermined thickness and before the bonding step. In the case of aluminum alloy matrix mataerials, an aluminum alloy cover foil, typically 1100 aluminum alloy, is placed at the top and bottom of the stack of sheets. Contact is thus prevented between the die material and the composite material thereby preventing chemical reaction between the die release agent and the composite constituents. While any aluminum alloy may be used in the foil, it is preferable to use an alloy whose solidus temperature is higher than the liquidus temperature of the matrix alloy of the composite, thereby ensuring that the cover foils remain solid during the entire process. Where the higher melting aluminum foils are used, the final product is clad with the wrought foil. This imparts the added benefit of corrosion resistance afforded by such pure aluminum foils as 1100 aluminum alloy.

The process is adaptable to the preparation of composites wherein the reinforcing material is in the form of chopped tow. The tow is chopped by use of scissors, paper cutter or any mechanized cutting device. The process is identical to that already described with certain variations. Where the fiber is difficult to bond chemically, as in the case of graphite or alumina, an additional 1 to 3% of magnesium or lithium powder is added to the matrix to act as a bonding agent.

For reinforcement fibers whose length to diameter ratio exceeds 100, there is a greater tendency toward clumping and segregation of particles from fibers. By use of a larger quantity of less viscous fluid binder, the problem of clumping is markedly decreased, and the matrix material is more readily transported within the clumped areas.

By partially drying the binder/matrix/fiber mix, so that the surface is dry but the center remains tacky, a light mechanical rolling breaks up any remaining clumped areas.

Finally, during the bonding sequence, the individual layers are off-gassed, then hot pressed to densify prior to final consolidation in the partially molten range. As this occurs, any clumped areas act as "thick spots" and are broken up during consolidation and bonding, thereby allowing the semi-molten matrix alloy to wet the reinforcing fibers evenly.

EXAMPLE 1

A composite was made comprising 20 percent by volume of SiC whiskers in 2024 aluminum matrix. The equivalent of 2024 aluminum was prepared by mixing 2.5 grams of magnesium powder with 250 grams of 2014 aluminum powder. These were mixed with 71 grams of SiC whiskers. A saturated solution of acrylic polymer in toluene was prepared, and the whisker/powder mixture was added with thorough mixing. The result was a uniform, viscous mixture, free of lumps. A screeding bed was prepared by attaching a film of 0.002 Mylar to a Masonite board, and two flat, metal strips, 0.025 inch thick, were clamped to the masonite on top of the Mylar. The strips were placed parallel such that a metal squeegee overlapped the strips by about 0.25 inch. The slurry was poured onto the Mylar film and screeded with the squeegee. The thin sheet thus prepared was allowed to air dry, and, after drying, was cut into 7 by 8 inch rectangles and removed from the Mylar backing film. The rectangles were stacked with a cover foil of 1100 aluminum alloy placed at the top and bottom of the stack. The stack was then placed in a die which was placed in a vacuum retort, and the pressure in the retort was reduced to about 200 microns with a vacuum pump.

The die was heated to 1180° F., the liquidus temperature of 2024 aluminum, and a pressure of about 500 psi was applied at this temperature for about 2 minutes. The die was allowed to cool while the pressure was increased approximately 250 psi for each 10° F. temperature drop until a maximum pressure of 2000 psi was reached. The temperature was then at about 1120° F. The die was further cooled at 2000 psi pressure to the solidus temperature of 2024 aluminum alloy, approximately 935° F. The applied pressure was removed, and the composite panel was removed for final cooling to room temperature.

The SiC/2024 aluminum composite panel was about 0.100 inch thick with cladding of 0.005 inch of 1100 aluminum alloy on each of the two major surfaces.

Tensile tests of a specimen cut from this panel showed the following results compared to 2024 aluminum, annealed:

| Property | Test Panel | 2024 aluminum annealed (typical) |
|---|---|---|
| Elastic Modulus | $16.59 \times 10^6$ | $10.6 \times 10^6$ |
| 0.2% Offset Yield Strength (psi) | 38,500 | 11,000 |
| Ultimate Tensile Strength (psi) | 55,370 | 27,000 |

We claim:

1. A process for manufacturing a composite material comprised of a matrix material reinforced with uniformly and randomly distributed and randomly oriented fibers or particles of a dissimilar material comprising the steps of:

(a) mixing matrix material powder and reinforcing material fibers in a viscous solution of an organic, polymeric binder in a solvent to form a slurry, said solution having a viscosity sufficient to result in suspension of said matrix material powder and said reinforcing material fibers in uniform and random distribution and with random orientation in said slurry;

(b) pouring said slurry to form a plurality of sheets each sheet having a thickness between 0.005 inches and 0.100 inches;

(c) air drying said sheets;

(d) arranging said air-dried sheets into a stack;

(e) removing said binder and binder solvlent from said stack of air-dried sheets at temperature up to 800 degrees Fahrenheit and vacuum pressure down to at least 200 microns;

(f) bonding and consolidating said stack of air-dried sheets at a temperature in the range from below the initial melting point of said matrix material to just above the temperature for complete melting of said matrix material, and at pressure in the range from 100 psi to 3000 psi;

(g) cooling said bonded and consolidated stack of air-dried sheets to ambient temperature and depressurizing to ambient pressure.

2. The process of claim 1 wherein said matrix material is selected from the group of metals comprising aluminum, copper, magnesium, titanium, aluminum alloys and ferrous alloys; and said reinforcing material is selected from the group of materials comprising silicon carbide whiskers, chopped boron fibers, chopped alumina tow, chopped graphite tow, chopped stainless steel wire, chopped tungsten wire, and chopped ferrous alloy wire.

3. The process of claim 2 wherein said reinforcing material is selected from the group of materials comprising chopped alumina tow and chopped graphite tow; and 1% to 3% of a bonding agent, selected from the group of materials comprising magnesium powder and lithium powder, is added.

4. The process of claim 1 wherein the particle size of said matrix material is in the range of from less than 325 mesh to less than 100 mesh.

5. The process of claim 1 wherein a first foil of high melting aluminum alloy is placed on top of said stack of sheets, and a second foil of high melting aluminum alloy is placed at the bottom of said stack of sheets at the end of step (d).

6. The process of claim 1 wherein the high temperature and pressure during step (f) are maintained for a period of time from 1 minute to 20 minutes.

7. The process of claim 1 wherein during step (f), pressure is raised to 500 psi; the temperature is raised to the liquidus range of said matrix material; the high temperature and pressure are maintained for a period of time from 1 minute to 20 minutes; said stack of sheets is cooled while pressure is raised, at the rate of 250 psi for each 10° F. drop in temperature, up to at least 2000 psi; said pressure is maintained until the temperature has dropped below the initial melting point of said matrix material; and the bonded and consolidated stack of sheets is cooled to ambient temperature and depressurized to ambient pressure.

* * * * *